United States Patent [19]

Kita et al.

[11] 3,974,762

[45] Aug. 17, 1976

[54] BANDING DEVICE

[76] Inventors: Edward Kiyoshi Kita, 1574 W. 183rd St., Gardena, Calif. 90248; Noriyoshi Matsui, 3630 W. 230th St., Torrance, Calif. 90505

[22] Filed: Oct. 24, 1975

[21] Appl. No.: 625,597

[52] U.S. Cl. ..... 100/9; 53/198 R; 53/390

[51] Int. Cl.[2] ..... B65B 13/02; B65B 67/00

[58] Field of Search ..... 53/198 R, 390; 100/9

[56] References Cited

UNITED STATES PATENTS 2,514,038 7/1950 Doolittle ..... 53/390 X

*Primary Examiner*—Travis S. McGehee
*Assistant Examiner*—John Sipos
*Attorney, Agent, or Firm*—W. C. Babcock

[57] ABSTRACT

Apparatus for disposing rubber bands around a movable fixture in preparation for banding of a produce bunch, including vertically articulated pins disposed around the periphery of a produce receiving opening, the pins being connected at their bottom ends to a vertically articulated spring-supported platform. The platform includes a vertically adjustable false bottom surface which is depressed by the produce bunch to withdraw the pins and release the rubber band to band the bunch. Also included is a rubber band dispensing yoke, Y-shaped in planform, having disposed on the center leg thereof a supply of rubber bands and having the two distal branch legs engaging selected pins. By way of this arrangement the rubber band is aligned over the exterior periphery of the selected pins and can then be manually stretched around the remaining pins.

8 Claims, 7 Drawing Figures

FIG. 1
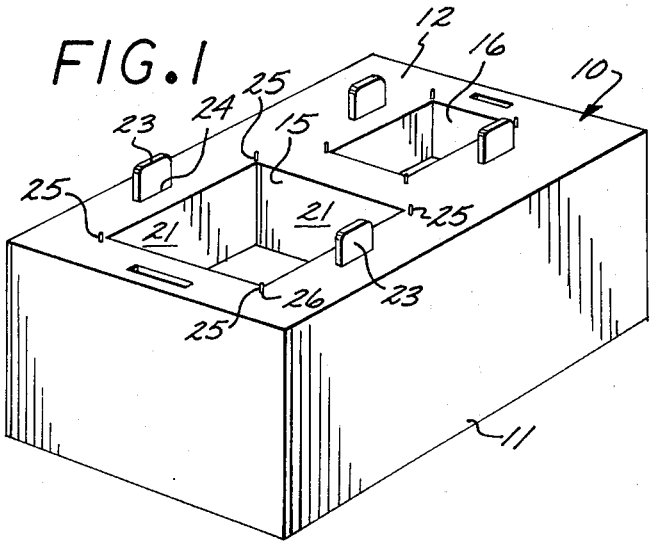
FIG. 2
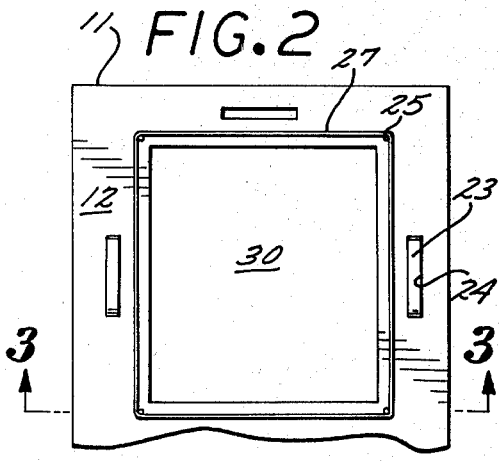
FIG. 3
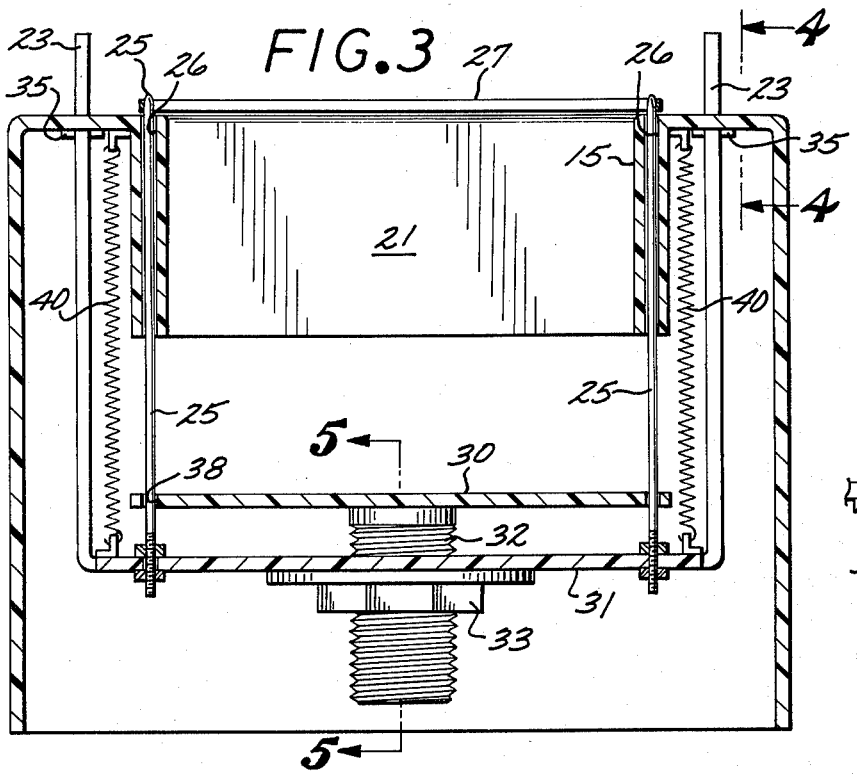
FIG. 4
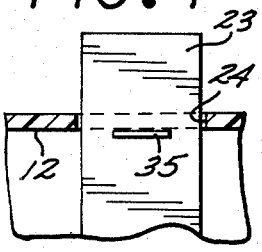
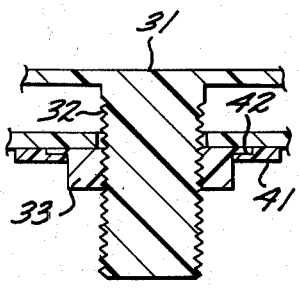
FIG. 5
FIG. 6
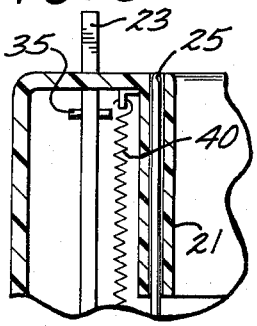
FIG. 7
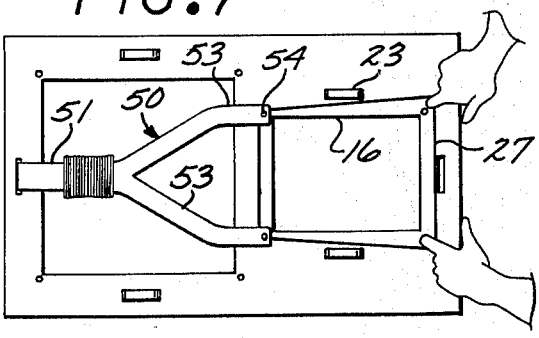

BANDING DEVICE

BACKGROUND OF THE INVENTION

1. Field of the Invention

The present invention relates to produce bundling apparatus, and more particularly to an apparatus adapted to band various bundles of produce.

2. Description of the Prior Art

The process involved in banding produce bunches, as for example bundles of long stalked produce like onions or celery which are usually vended in bundles, requires at present many manual operations, which at today's labor costs entail a large price increase in the cost of food. Generally, both the selection of the size of the bundle, and the banding step itself, is presently done by manual labor. Thus, labor time is expended both in the selection of the proper bundle size and in the banding. Most often stalked produce is banded by rubber bands following which the bundles may be either enclosed in a cellophane wrapper or are placed for storage in some storage facility. The additional step of wrapping the produce entails further manual labor, again raising the cost of the produce.

This involvement of manual labor has led to many attempts in the past which were directed at automating this part of the food production process. Most such prior art attempts, however, required complex automated systems which because of their complexity were too costly for many small truck farm operations. Furthermore, because of their complexity such automated prior art systems did not readily adapt to the various kinds of produce which a typical farming operation must entail as the farm land is cycled in order to maintain the productivity thereof. This lack of flexibility again raised the cost to the small farmer to the point where a small farming facility is now not competitive with large farming cooperatives.

SUMMARY OF THE INVENTION

Accordingly, it is the general purpose and object of the present invention to provide a banding device which assists the manual function of the personnel involved in produce banding and which furthermore, by virtue of its arrangement of parts, allows convenient adaptation for banding various forms of produce.

Other objects of the invention are to provide a banding device which is adapted for simultaneous wrapping of the produce bunch concurrently with the banding.

Yet other objects of the invention are to provide a banding device which is easy to produce, easy to maintain, and which can be manually articulated.

Briefly, these and other objects are accomplished within the present invention by providing a rectangular enclosure which can be easily positioned in any desired location, the enclosure having formed on the upper surface thereof a plurality of openings, each sized for a particular produce bundle. Disposed around the periphery of each opening is a downwardly directed liner, open at the bottom thereof, the function of such liner being to provide containment for the particular produce bunch, and to direct the produce bunch downwardly. Disposed below the opening of the liner is a spring-supported platform or bottom plate which includes on the upper surface thereof a selectively adjustable false bottom surface. This false bottom surface can be raised or lowered relative to the bottom opening of the liner to thereby determine the depth at which the produce bundle bottoms out and where it is banded.

More specifically, the bottom plate is connected at two distal edges thereof to two upwardly extending, vertically aligned guide tabs which in turn are received within corresponding guide slots along the periphery of the opening to extend to the exterior of the rectangular enclosure along two opposed sides of the rectangular liner. To control the upward displacement of the bottom plate, the guide tabs are further provided with stops which engage the top surface from below, preventing further upward progression of the guide tabs through the slots to thus control the vertical upward stroke of the platform. The bottom plate or platform is secured to the underside of the top surface by a plurality of springs which urge the bottom plate upwardly, abutting the stops against the upper surface of the rectangular enclosure. In this manner the depth of the opening is set by the vertical dimension of the stops and can be further adjusted by extending the false bottom surface upwardly or downwardly relative to the bottom plate.

Extending upwardly from the bottom plate are four pins arranged to project through corresponding four guide holes in the false bottom surface into four pin holes disposed proximate the corners of the corresponding rectangular opening. The longitudinal dimension of these pins is selected to allow a partial projection of the pin end on the exterior of the upper surface of the rectangular enclosure. The projecting end of the pins are thus exposed to engage a rubber band thereabout and a subsequent depression of the platform, will release the rubber band to surround the bundle of produce, thus banding the dundle with a single manual articulation. The supply of rubber bands is replenished from a Y-shaped yoke, which at its center leg is secured to the rectangular enclosure and which at its two branches includes pin-receiving holes adapted to receive selected ones of the pins.

By this arrangement a plurality or a number of rubber bands loosely mounted on the center of the Y-yoke can be manually stretched, engaging the pins received in the yoke and aligned to engage the other pins around the enclosure. As the produce bunch is then banded and the stretched rubber band is released to surround the bunch, a subsequent or succeeding rubber band is similarly placed around the four pins in preparation in the banding of the next bunch. In this manner a semi-automatic banding sequence can be established which is quite convenient to use and inexpensive to produce, and can therefore be made available to small farm facilities.

BRIEF DESCRIPTION OF THE DRAWING

FIG. 1 is a perspective illustration of the banding device constructed according to the present invention;

FIG. 2 is a partial top view of the banding device shown in FIG. 1;

FIG. 3 is a side view, in section, taken along line 3—3 of FIG. 2;

FIG. 4 is a partial front view of a section, taken along line 4—4 of FIG. 3;

FIG. 5 is a detailed view, taken along line 5—5 of FIG. 3;

FIG. 6 is a sectional view corresponding to a sectional detail of FIG. 3 during articulation; and FIG. 7 is a top view of the banding device shown in FIG. 1 illustrating an inventive rubber band dispensing yoke mounted on the surface thereof.

DESCRIPTION OF THE SPECIFIC EMBODIMENT

As shown in FIG. 1, the inventive banding device generally designated by the numeral 10, comprises a rectangular enclosure 11, having formed on the upper surface 12 thereof, two rectangular openings 15 and 16. Openings 15 and 16 are sized to receive a produce bundle of predetermined size, and are functionally arranged to cooperate in a similar manner with other mechanical structure to be further described. Thus, the only distinction between the mechanisms associated with each opening is in the size thereof. Accordingly, the following description will be directed primarily at the functional arrangement of parts around opening 15, it being understood that opening 16 is similarly implemented.

Extending downwardly from the peripheral edge of opening 15, into the interior of the opening is a rectangular liner 21. Disposed within the enclosure 11 and along the exterior of two laterally opposed surfaces of liner 21 are two guide tabs 23 which project to the exterior of the enclosure through associated guide slot 24. Similarly, four pins 25 project through corresponding pin holes 26 in the upper surface 12 respectively at the corners of opening 15. The projecting ends of pins 25 are thus adapted to engage a rubber band stretched thereabout. In a manner to be further described, pins 25 are disposed for concurrent vertical articulation with the vertical articulation of guide tabs 23. Thus, if the guide tabs 23 are depressed, pins 25 are concurrently withdrawn into the interior of the rectangular housing 11, releasing the rubber band stretched thereabout. A bundle of produce bunched to fit the particular opening and inserted therein will thus be banded.

As shown in FIG. 2, the rubber band designated by the numeral 27 is stretched around pins 25 in preparation for receipt of the produce bundle. The bottom edge of the liner 21 in opening 15 is aligned over a false bottom surface 30 which is operatively attached to the guide tabs 23 and pins 25 whereby pressing the produce bundle against the bottom surface 30 provides a downward articulation of tabs 23 and concurrently pins 25.

As shown in more detail in FIG. 3, the false bottom surface 30 is shown disposed above a bottom plate or platform 31 by way of a screw jack arrangement comprising a threaded stud 32 extending downwardly from the bottom surface 30 to engage a nut 32 mounted for rotation on the lower side of plate 31. Plate 31 extends between the vertically extending guide tabs 23 attached to the distal edges thereof; tabs 23 being further provided with stops 35 on the lateral surfaces thereof for engaging the underside of the surface 12 around the slots 24. Stops 35 therefore provide an upward motion limit for the return stroke of the bottom plate 31. Mounted to bottom plate 31 and extending upwardly therefrom are the aforementioned pins 25 which extend through the false bottom surface 30 at corresponding guide holes 38 formed therein to project through the top surface 12 through similarly provided pin holes 26.

The platform assembly or the combination of the false bottom surface 30 and the bottom plate 31 is suspended from the underside of the upper surface 12 by a plurality of springs 40. In this manner a spring-supported platform is provided which is limited in its upward stroke by stops 35 formed on the guide tabs 23, and which can be depressed downwardly from this upper limit either by pressing the bundle against the bottom surface 30 or by manual depression of the exposed ends of the guide tabs 23. When depressed from this upper limits, the platform arrangement concurrently withdraws pins 25 into the interior of enclosure 11, releasing the rubber band 27 stretched thereabout to snap around the produce bundle.

The provisions for limiting the upward articulation of the platform assembly comprising the false bottom 30 and the bottom plate 31 are shown in more detail in FIG. 4. More specifically in FIG. 4 the guide tab 23 is shown slidably projecting through slot 24. The stops 35 are mounted on guide tab 23 and thus the stops 35 will abut the underside of slot 24 preventing upward motion of the guide tabs. The tabs in turn limit the further upward motion of the platform.

Since the application of this device is adapted to various produce banding processes and since the banding point of a particular product line must necessarily accommodate the various lengths and the various root configurations, the separation of the false bottom surface 30 from the under side of the liner 21 is therefore necessarily adjustable. As previously stated, this separation is accommodated by way of the stud 32 engaging nut 33.

As shown in more detail in FIG. 5, nut 33 is attached to the underside of plate 31. To allow for freedom of rotation of nut 33 the attachment thereof to plate 31 is made by way of an annular retainer 41 which engages a projecting lip 42 formed on the circumference of nut 33 to expose the hexagonal surfaces of the nut therebelow. Thus, nut 33 is free to rotate within the annular opening of retainer 41, but is retained both in the upward and downward direction by the combination of the angular retainer 41 and the plate 31.

In addition to the features described above, a rubber band dispensing yoke generally designated by the numeral 50 is provided. By specific reference to FIG. 7, yoke 50 is generally conformed to a Y-shaped planform having a center leg 51 thereof turned downwardly at the end to be received in a corresponding slot 52 formed on the upper surface 12. The Y-shaped yoke 50 includes the two legs of the Y shown herein as legs or straps 53, each being provided with a pin opening 54 at the free end thereof in alignment to receive pins 25 therein.

It is therefore contemplated to loosely stack a plurality of rubber bands 27 of the center leg 51 of the yoke 50 and then in sequence, as the rubber bands are used up, to manually stretch successive rubber bands 27 over the two pins 25 received within openings 54. From this alignment the rubber bands 27 are stretched to engage the other two pin ends around the opening. This arrangement of parts allows for a convenient supply of rubber bands which are furthermore conveniently arranged for easy disposition around the pins. In this illustration, yoke 50 is shown disposed over the opening 15 to allow for dispensing rubber bands 27 around the opening 16. It is to be understood that the alignment of a yoke properly conformed to the pin location around opening 15 can be similarly made by disposing such yoke over the opening 16.

The operation of the present invention will now be taken up with particular reference to FIGS. 3, 4, 5, 6, and 7. When in use the attending person may elect to dispose a sheet of wrapping material (not shown) over the particular opening selected for the desired bundle size and by inserting the produce bundle (not shown) into the opening will concurrently wrap the produce bundle and band it. In the process of banding the produce bundle whether contained in a wrapper or not, the bundle is depressed against the false bottom surface 30. Depression of the false bottom 30 concurrently withdraws pins 25 into the enclosure 11, releasing the rubber band 27 stretched thereabout.

The bundle is then withdrawn from the opening, allowing the platform to return to its upper limit and exposing the ends of pins 25 for the next successive engagement of a rubber band 27 thereabout. The rubber bands 27 are conveniently arranged on the yoke 50 for this preparatory operation.

In instances where produce such as lettuce or cabbage are to be banded by way of this device similar procedure can be utilized. The procedure is best illustrated by reference to FIG. 6 where the articulation of tabs 23 is shown providing the requisite withdrawal of pins 25 from their engaging position. In this procedure the wrapping material is again placed over the stretched rubber band, the lettuce head or cabbage head is then pressed into the opening 15 to rest on the bottom surface and subsequent thereto, the exposed guide tabs are both depressed with the resulting release of rubber band 27 to close the wrapper.

Some of the many advantages of the present invention should now be readily apparent. The invention provides by way of means which are simple to produce, convenient to maintain, and easy to manipulate a device which in one stroke bands either a produce bunch or closes a wrapper around various leafy farm products. This device provides without the use of power equipment and in an inexpensive form which is accessible to farm producers of small size.

Obviously, many modifications and variations of the present invention will be apparent to those skilled in the art. It is therefore intended that the scope of the invention be solely limited by the claims appended hereto.

We claim:

1. Apparatus for banding bundles of produce, comprising:

an enclosure having an opening formed therein adapted to receive said bundles of produce;

platform means disposed across said opening within said enclosure;

urging means connected between said enclosure and said platform means for urging said platform means towards said opening of said enclosure;

stop means mounted on said platform means for limiting the progression thereof towards said enclosure;

a plurality of pins mounted on said platform means and extending to the exterior of said enclosure at selected points proximate the periphery of said opening when said stop means is at its limiting position; and band dispensing means mounted on said enclosure and engaging selected ones of said pins thereat for storing a supply of elastic bands thereon and aligning said bands relative to said pins.

2. Apparatus according to claim 1 wherein:

said platform means includes a first planar member disposed below said opening and a second planar member adjustably secured between said first planar member and said opening.

3. Apparatus according to claim 2 wherein:

said urging means includes a plurality of springs connected between said first planar member and said enclosure; and said stop means includes guide tabs extending from said first planar member to slidably project through said enclosure proximate said opening therein, said guide tabs including stop elements formed thereon for engaging said enclosure at a predetermined point of projection thereof.

4. Apparatus according to claim 3 wherein:

said bands are rubber bands; and said band dispensing means is a yoke formed in the manner of a Y-shaped planar member having the center leg thereof engaged to said enclosure and the branch legs thereof disposed to engage said selected pins on the exterior of said enclosure, whereby said rubber bands are disposed on said center leg and are aligned along said selected pins upon manual dispensing thereof.

5. Apparatus for banding bundles of articles, comprising:

an enclosure having an opening formed therein for limiting the size of the bundle received on the interior thereof;

a platform disposed within said enclosure across said opening;

a plurality of springs connecting said platform to said enclosure at selected points proximate said opening;

guide tabs connected to said platform and vertically extending therefrom to slidably project to the exterior of said enclosure;

stop elements formed on said guide tabs for limiting the progression thereof through said enclosure; and a plurality of pins mounted on said platform to project through said enclosure along the periphery of said opening for engaging a rubber band thereabout.

6. Apparatus according to claim 5 further comprising:

a sleeve disposed along the periphery of said opening and projecting towards said platform, the projecting dimension of said sleeve being less than the dimension separating said platform from said enclosure.

7. Apparatus according to claim 6 further comprising:

a bottom planar member adjustably secured to said platform at a selected position between said platform and said sleeve.

8. Apparatus according to claim 7 further comprising:

band dispensing means including a york formed in the manner of a Y-shaped planar member having the center leg thereof engaged to said enclosure and the branch legs thereof disposed to engage said selected pins on the exterior of said enclosure, whereby said rubber bands are disposed on said center leg and are aligned along said selected pins upon manual dispensing thereof.

* * * * *